US010900486B2

(12) United States Patent
Kuvaja et al.

(10) Patent No.: US 10,900,486 B2
(45) Date of Patent: Jan. 26, 2021

(54) LUBRICATION SYSTEM

(71) Applicant: Metso Minerals, Inc., Helsinki (FI)

(72) Inventors: Kari Kuvaja, Tampere (FI); Aki Lautala, Tampere (FI)

(73) Assignee: Metso Minerals, Inc., Helsinki (FI)

( * ) Notice: Subject to any disclaimer, the term of this patent is extended or adjusted under 35 U.S.C. 154(b) by 236 days.

(21) Appl. No.: 15/756,792

(22) PCT Filed: Sep. 14, 2015

(86) PCT No.: PCT/FI2015/050604
§ 371 (c)(1),
(2) Date: Mar. 1, 2018

(87) PCT Pub. No.: WO2017/046438
PCT Pub. Date: Mar. 23, 2017

(65) Prior Publication Data

US 2018/0252217 A1 Sep. 6, 2018

(51) Int. Cl.
*F04B 53/18* (2006.01)
*F04C 29/02* (2006.01)
*B02C 2/04* (2006.01)

(52) U.S. Cl.
CPC ..... *F04C 29/025* (2013.01); *B02C 2/047* (2013.01); *F04C 2240/56* (2013.01)

(58) Field of Classification Search
CPC . B02C 2/00; F04B 53/18; F04B 19/22; F16N 13/02; F16N 13/06; F01M 1/02; F01M 1/06; F04C 29/023; F04C 29/025
See application file for complete search history.

(56) References Cited

U.S. PATENT DOCUMENTS 4,084,756 A 4/1978 Coxhill
4,339,087 A 7/1982 Pollak
6,328,237 B1 12/2001 Thysell
7,922,109 B2 4/2011 Persson
(Continued)

FOREIGN PATENT DOCUMENTS

CN 102256708 A 11/2011
CN 102834034 A 12/2012
(Continued)

OTHER PUBLICATIONS

PrecisionScreen, "Sandvik QH440 Mobile Cone Crusher", Jun. 26, 2011, Youtube, https://www.youtube.come/watch?v=Mu9pGQJic-w (Year: 2011).*
(Continued)

*Primary Examiner* — Adam J Eiseman
*Assistant Examiner* — Dylan Schommer
(74) *Attorney, Agent, or Firm* — Andrus Intellectual Property Law, LLP

(57) ABSTRACT

A mineral material processing plant, a crusher, a lubrication method and system, the system including a thrust bearing, a lubrication piston and adjusting piston arranged to be movable in a cylinder. The piston includes a first space configured to receive fluid and to continuously conduct the fluid to the thrust bearing. The cylinder and the piston define therebetween a second space configured to receive and hold fluid. The system is configured to, in response to detecting a downward movement of the piston, conduct fluid to the first space.

21 Claims, 4 Drawing Sheets

(56) References Cited

U.S. PATENT DOCUMENTS

| | | | | |
|---|---|---|---|---|
| 2010/0155512 | A1* | 6/2010 | Persson | F16C 32/067 241/27 |
| 2011/0006143 | A1* | 1/2011 | Gunnarsson | B02C 2/04 241/215 |

FOREIGN PATENT DOCUMENTS

| | | | | |
|---|---|---|---|---|
| FR | 2617740 | A1 * | 1/1989 | B02C 2/042 |
| JP | S47-25752 | | 10/1972 | |
| JP | S47-36045 | A | 11/1972 | |
| JP | S61-46263 | A | 3/1986 | |
| JP | H721130 | U | 4/1995 | |
| RU | 2524094 | C2 | 7/2014 | |
| SU | 1045909 | A1 | 10/1983 | |
| WO | 2009/066001 | A1 | 5/2009 | |

OTHER PUBLICATIONS

International Search Report and Written Opinion for PCT/FI2015/050604 dated Jun. 10, 2016.
International Preliminary Report on Patentability for PCT/FI2015/050604 dated Dec. 6, 2017.
Office Action for corresponding Japanese Patent Application No. 2018-512131 dated Jul. 29, 2019.
Office Action for Chinese Patent Application No. 2015800830626 dated May 17, 2019.
Office Action for Russian Patent Application No. 2018110185, dated Apr. 16, 2019.
Notice of Allowance for corresponding Japanese Patent Application No. 2018-512131 dated Aug. 6, 2020.

* cited by examiner

LUBRICATION SYSTEM

CROSS-REFERENCE TO RELATED APPLICATIONS

This application is the U.S. national stage application of International Application PCT/FI2015/050604 filed Sep. 14, 2015, which international application was published on Mar. 23, 2017, as International Publication WO 2017/046438 in the English language.

FIELD OF INVENTION

The invention generally relates to a gyratory crusher. In particular, but not exclusively, the invention relates to a lubrication system for a gyratory crusher.

BACKGROUND OF THE INVENTION

Mineral material, such as stone, is retrieved to be processed from the ground either by exploding or by digging. The mineral material may also comprise natural stone, gravel and construction waste. Both mobile and fixed plants are used for processing. The material to be processed is fed with e.g. an excavator or a wheel loader into a feed hopper of the processing plant, from where the material is forwarded to be processed.

In a gyratory crusher, eccentric movement of the main shaft causes the mineral material to be crushed in a crushing chamber between an inner wear part connected to the main shaft and an outer wear part connected to the frame of the crusher. The main shaft, or the head of the crusher, is supported at its bottom by a thrust bearing and an piston.

The thrust bearing receives the crushing forces and needs to be lubricated. The lubricating fluid is conducted to the thrust bearing via a hollow in the piston. Such arrangements are known e.g. from patent publications U.S. Pat. Nos. 7,922,109 and 6,328,237.

In case of a tramp release, i.e. in a situation in which uncrushable material ends up in the crushing chamber, the main shaft, or head, rapidly moves downwards causing the thrust bearing to receive a large surface force and friction losses. In such a case the lubrication sufficient in a normal operating situation might prove inadequate.

The objective of the invention is to provide a lubrication system for a gyratory crusher with an piston, a thrust bearing and lubrication thereof mitigating the problems of the prior art.

SUMMARY

According to a first aspect of the invention there is provided a lubrication system for a gyratory crusher, comprising

- a thrust bearing, a lubrication piston and adjusting piston arranged to be movable in a cylinder; wherein
- the piston comprises a first space configured to receive fluid and to continuously conduct the fluid to the thrust bearing; and wherein
- the cylinder and the piston define therebetween a second space configured to receive and hold fluid; and
- the system is configured to in response to detecting a downward movement of the piston to conduct fluid to the first space.

The system may be further configured to in response to the pressure rising in the second space to conduct fluid from the second space to the first space.

The lubrication system may further comprise a first channel connecting the first space with the outside of the piston.

The lubrication system may further comprise second channel formed between the side surface of the piston and the cylinder; and connecting the first space with the second space.

The lubrication system may further comprise a third channel connecting the second channel to a supply of fluid.

The lubrication system may further comprise a fourth channel connecting the second space to the first space.

The lubrication system may further comprise a third space above the thrust bearing inside the cylinder configured to receive fluid from the thrust bearing.

The lubrication system may further comprise a fifth channel connecting the third space to the supply of fluid.

The system may be configured to in response to the pressure rising in the second space to conduct fluid from the second space to the first space via the first channel and the second channel and/or via the fourth channel.

The lubrication system may further comprise further fluid transfer means for additionally supplying fluid to the first space in response to detecting the downward movement of the piston.

The further fluid transfer means may comprise a pump.

According to a second aspect of the invention there is provided a lubrication method for a gyratory crusher, comprising

- supplying fluid to a first space inside a piston configured to receive fluid; continuously conducting the fluid from the first space (30) to a thrust bearing; wherein
- in response to detecting a downward movement of the piston conducting fluid to the first space.

The method may comprise supplying to and holding fluid in a second space between the cylinder and the piston; and in response to the pressure rising in the second space conducting fluid from the second space to the first space.

The fluid may be supplied to the first space via a first channel, a second channel and a third channel connected to a supply of fluid.

The fluid may be supplied to the second space via the second channel.

The fluid may be supplied from the thrust bearing to a third space above the thrust bearing inside the cylinder.

The fluid may be supplied from third space to the supply of fluid via a fifth channel.

The fluid may be supplied in response to the pressure rising in the second space to the first space via the first channel and the second channel and/or via a fourth channel.

The fluid may be supplied to the first space in response to detecting the downward movement of the piston additionally using further fluid transfer means.

The further fluid transfer means may comprise a pump.

According to a third aspect of the invention there is provided a gyratory crusher comprising a lubrication system of the first aspect.

According to a fourth aspect of the invention there is provided a mineral material processing plant comprising a crusher according to the third aspect.

The mineral material processing plant may comprise a mobile plant.

Different embodiments of the present invention will be illustrated or have been illustrated only in connection with some aspects of the invention. A skilled person appreciates that any embodiment of an aspect of the invention may apply to the same aspect of the invention and other aspects

BRIEF DESCRIPTION OF THE DRAWINGS

The invention will now be described, by way of example, with reference to the accompanying drawings, in which.

DETAILED DESCRIPTION

In the following description, like numbers denote like elements. It should be appreciated that the illustrated figures are not entirely in scale, and that the figures mainly serve the purpose of illustrating embodiments of the invention.

Figure 1:
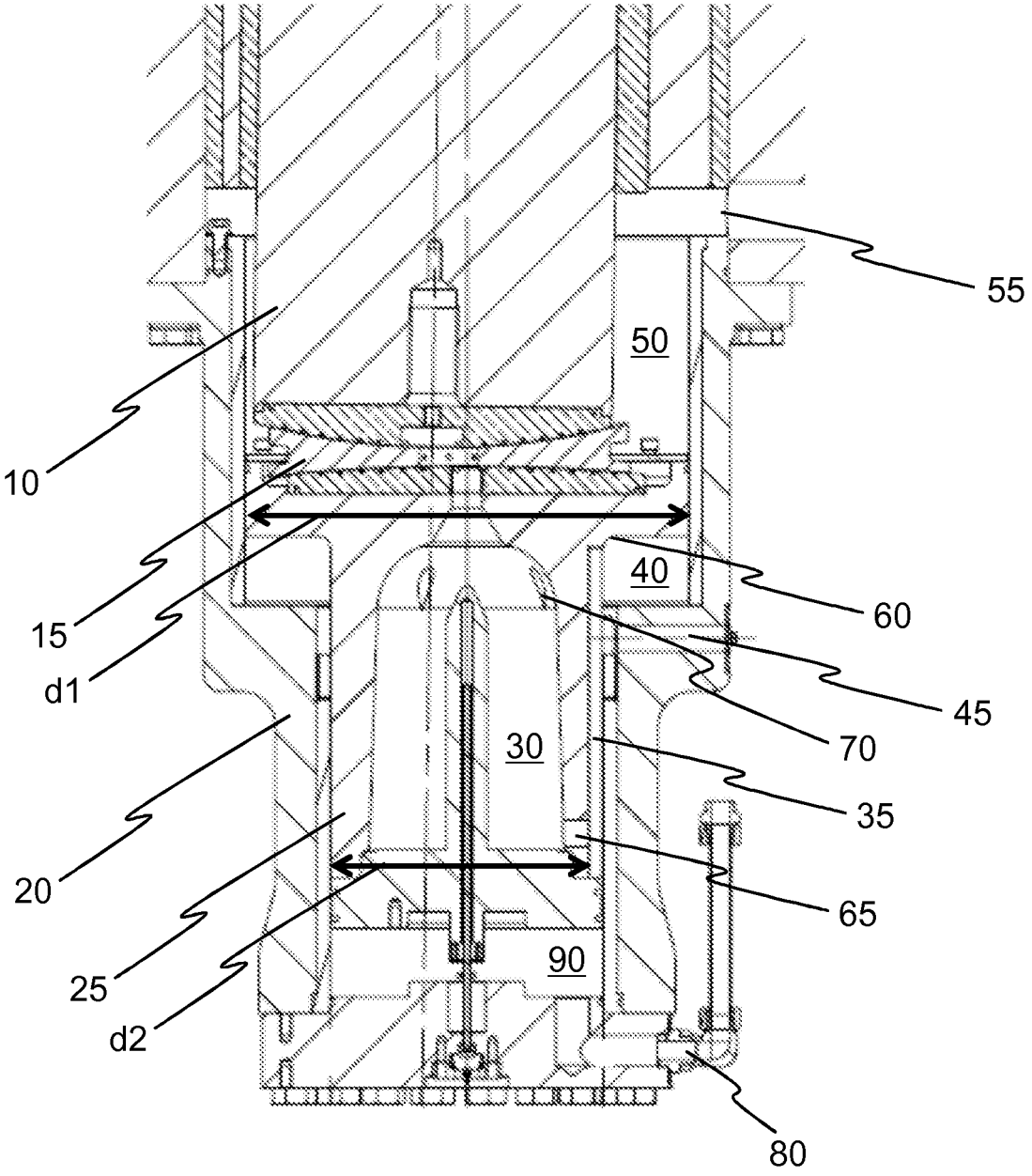
FIG. 1 shows a schematic cross-sectional view of a lubrication arrangement of a gyratory crusher according to an example embodiment of the invention.

FIG. 1 shows a schematic cross-sectional view of a lubrication arrangement of a gyratory crusher according to an example embodiment of the invention. FIG. 1 shows a portion of a gyratory crusher comprising a main shaft 10 supported by a thrust bearing 15 and an adjusting piston, or piston, 25. The piston 25 resides and is movable in a cylinder 20. In a further example embodiment, the gyratory crusher comprises a fixed main shaft 10 and the thrust bearing resides above the main shaft supporting a head of the crusher. In such a case, an adjusting piston is located at the lower end of the main shaft, and the thrust bearing is supported by a lubrication piston with the structure and functioning as described hereinafter with reference to the piston 25.

The piston 25 has a first diameter d1 and a second diameter d2. The first diameter d1 is larger than the second diameter d2, and the piston is formed in such a way as to have a shoulder 60 between the two diameters, i.e. the cross-section of the piston 25 has a shape reminiscent of the letter T. The shape, i.e. the inner diameter, of the cylinder 20 substantially corresponds to the shape and diameters of the piston.

The piston 25 is hollow and comprises a first space 30 configured for conducting fluid towards and into the thrust bearing 15. The thrust bearing is of the conventional type comprising for example lubrication grooves for spreading the fluid to the surfaces thereof. The piston 25 further comprises a first channel, or duct, 65 configured for conducting fluid into the first space 30, i.e. the first channel 65 connects the first space 30 with the outside of the piston 25. In a further example embodiment, the lubrication system comprises further fluid transfer means, e.g. such as a pump, (not shown) for additionally supplying fluid to the first space (30) in response to detecting a tramp release. The system comprises in an embodiment means for detecting the tramp release e.g. electronic means or a pressure valve. In case of a tramp release, the pressure under the piston 25 rises, i.e. in a pressure volume 90. The pressure is detected by a pressure sensor or a pressure valve 80, which is configured to open when the pressure exceeds a predetermined limit value and the piston 25 moves downwards.

The cylinder 20 and the piston 25 are formed in such a way that a second space 40 is formed between the portion of the piston having the first diameter d1 and the portion of the cylinder 20 having the smaller diameter corresponding to the second diameter d2 of the piston 25. The volume of the second space is variable in accordance with the movement of the piston 25 in the cylinder 20. For example in case of a tramp release as the piston 25 rapidly moves downwards, the volume of the second space 40 decreases rapidly.

A second channel, or duct, 35 is formed between the side surface of the piston 25 and the cylinder 20. In an example embodiment, the second channel 35 is formed as groove in the surface of the piston 25 and/or the cylinder 20. The second channel 35 is connected, i.e. in fluid connection, with the first channel 65 and with the second space 40. The cylinder 20 comprises a third channel, or duct, 45 in fluid connection with the second channel 35. The third channel 45 is in fluid connection with a supply of lubricating fluid (not shown) and is configured to conduct the fluid into the second channel 35 and therethrough into the first space 30 via the first channel 65 and to the second space 40.

In an embodiment, the piston 25 comprises a fourth channel 70 connecting the first space 30 to the second space 40. The fourth channel 70 is configured for conducting fluid from the second space 40 into the first space 30. In a further embodiment, the fourth channel comprises several channels, ducts or holes. In a further example embodiment additional fluid is supplied to the first space (30) in response to detecting a tramp release using further fluid transfer means such as a pump. The tramp release is in an embodiment detected e.g. electronically or mechanically by a pressure valve 80.

A third space 50 is formed above the thrust bearing 15 inside the cylinder 20. The third space is configured for receiving lubricant from the thrust bearing 15 and for conducting the heated lubricant back to the lubricant supply (not shown) to be cooled via a fifth channel, or duct, 55. In a further example embodiment, in addition to or instead of the fifth channel 55, the heated lubricant received from the thrust bearing is conducted further through radial bearings (not shown).

Figure 2:
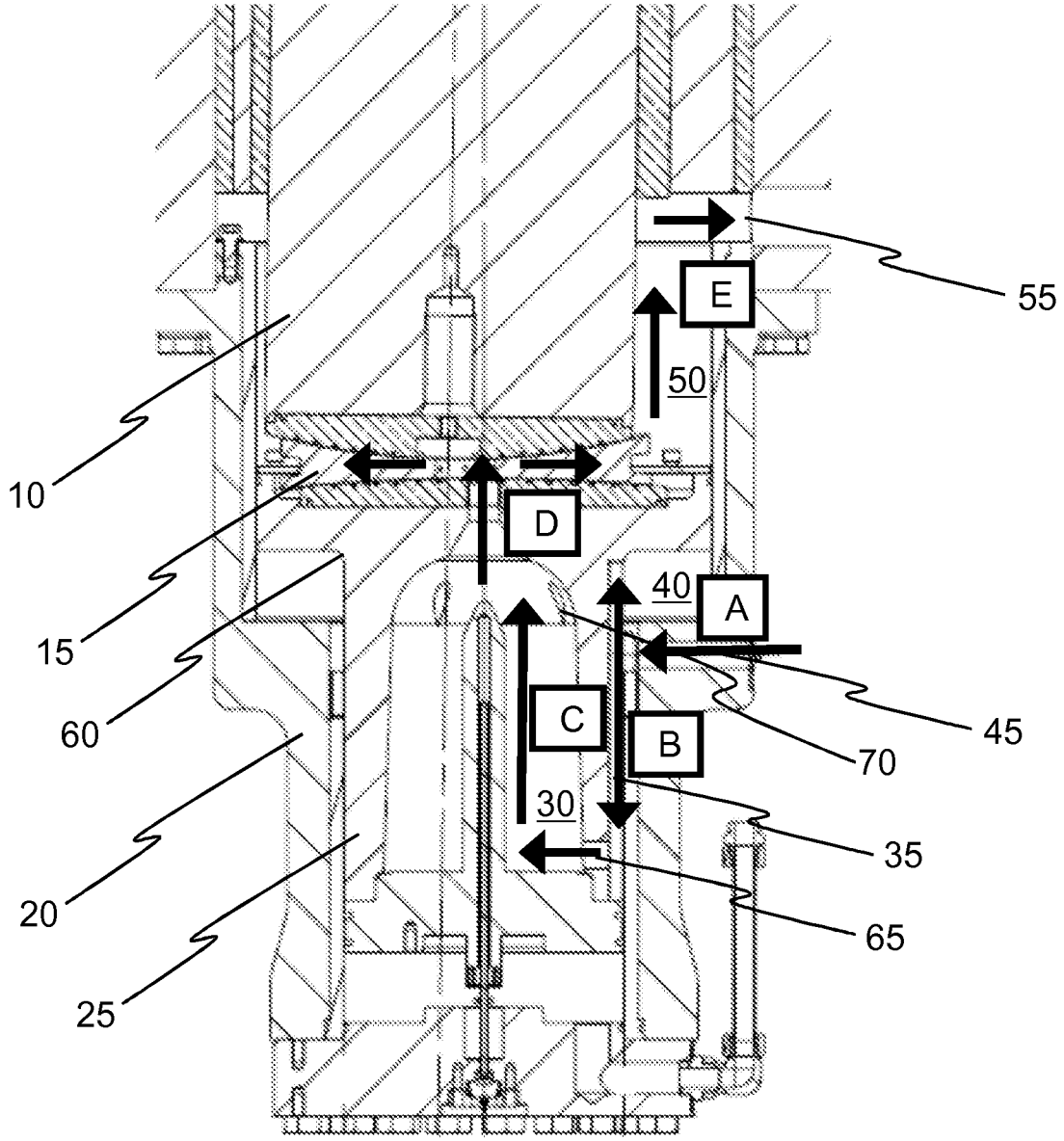
FIG. 2 shows a principle view of lubrication of the thrust bearing of a gyratory crusher according to an example embodiment of the invention.

FIG. 2 shows a principle view of lubrication of the thrust bearing of a gyratory crusher according to an example embodiment of the invention. Lubricant fluid is supplied at A through the third channel 45 to the second channel 35 from which channel the fluid is conducted at B to the second space 40 and to the first channel 65. From the first channel 65 the fluid is conducted at C to the first space 30 from which it is conducted at D to the thrust bearing 15 where it spreads to the lubrication grooves and surfaces of the thrust bearing 15. The used and heated lubricant fluid ends up from the thrust bearing into the third space 50 and is conducted at E back to the lubricant supply to be cooled via the fifth channel 55. The lubrication method of FIG. 2 corresponds to the normal operation of the crusher.

Figure 3:
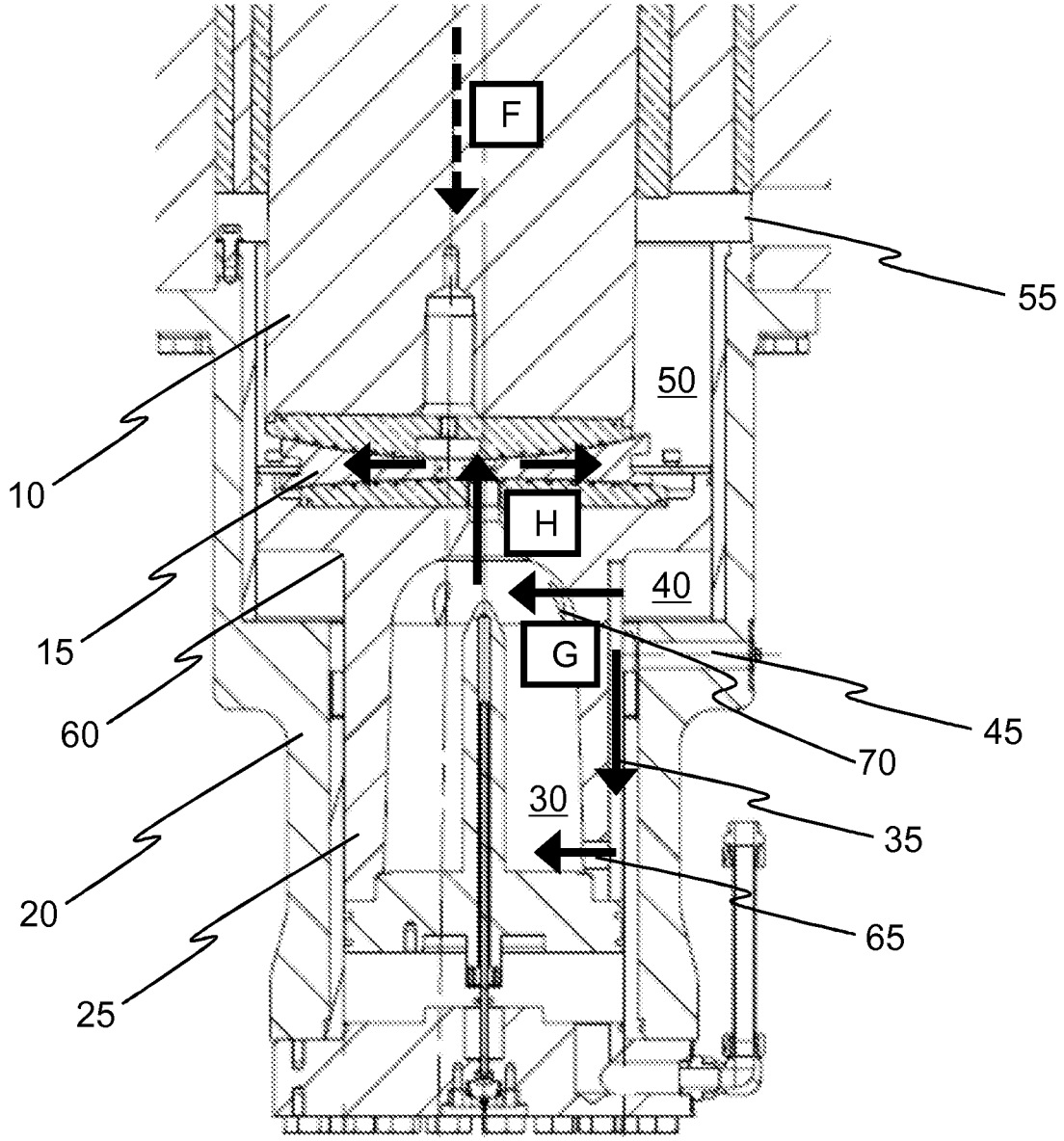
FIG. 3 shows a further principle view of lubrication of the thrust bearing of a gyratory crusher according to an example embodiment of the invention.

FIG. 3 shows a further principle view of lubrication of the thrust bearing of a gyratory crusher according to an example embodiment of the invention. The main shaft 10 moves rapidly downwards at F due to a tramp release situation and accordingly, the thrust bearing 15 experiences large surface forces while it also moves downwards together with the piston 25. The volume of the second space 40 is reduced as the piston 25 moves downwards and the pressure rises in the second space 40. In response to the pressure rising in the second space 40, fluid is conducted at G from the second space 40 via the second channel 35 and the first channel 65 and/or also via the fourth channel 70 into the first space 30. Thus increasing the amount of fluid in the first space 30, i.e. the fluid flowing from the second space 40 adds to the normal lubrication operation flow of the fluid shown in FIG. 2. From the first space 30 the fluid is conducted at H to the thrust bearing 15 and the lubrication of the thrust bearing increases in comparison to normal operation and danger of overheating or damage to the thrust bearing due to the tramp release situation is lessened.

Figure 4:
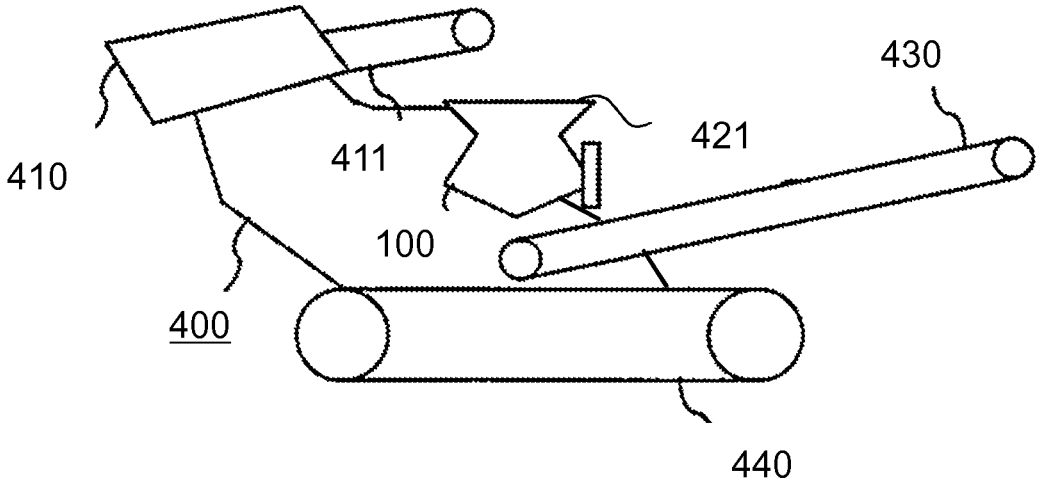
FIG. 4 shows a mineral material processing plant according to an example embodiment of the invention.

FIG. 4 shows a mineral material processing plant 400 according to an example embodiment. The mineral material processing plant 400 comprises a gyratory crusher 100 according to an example embodiment comprising the lubrication arrangement according to an example embodiment of the invention. The crusher can be used as a primary crusher, or for example as an intermediate or secondary crusher, furthermore the crusher can be used in fine crushing. In an example embodiment, the mineral material processing plant 400 further comprises a feeder 410 and conveyors 411,430. The mineral material processing plant according to an example embodiment is a mobile mineral material processing plant and comprises a track base 440. Furthermore, a skilled person appreciates that the mineral material processing plant may comprise other parts and/or units not shown in FIG. 4, such as a motor and hydraulic circuits, and/or that some parts shown in FIG. 4 may not be present.

The material to be crushed is in an example embodiment fed to the feeder 410 and therefrom by the conveyor 411 to the crusher 100. The feeder 410 may also be a so-called scalper feeder. The material to be crushed coming from the conveyor is directed to the feed opening 421. In a further example embodiment, the material to be crushed is fed to the feed opening directly, for example by a loader.

Figure 5:
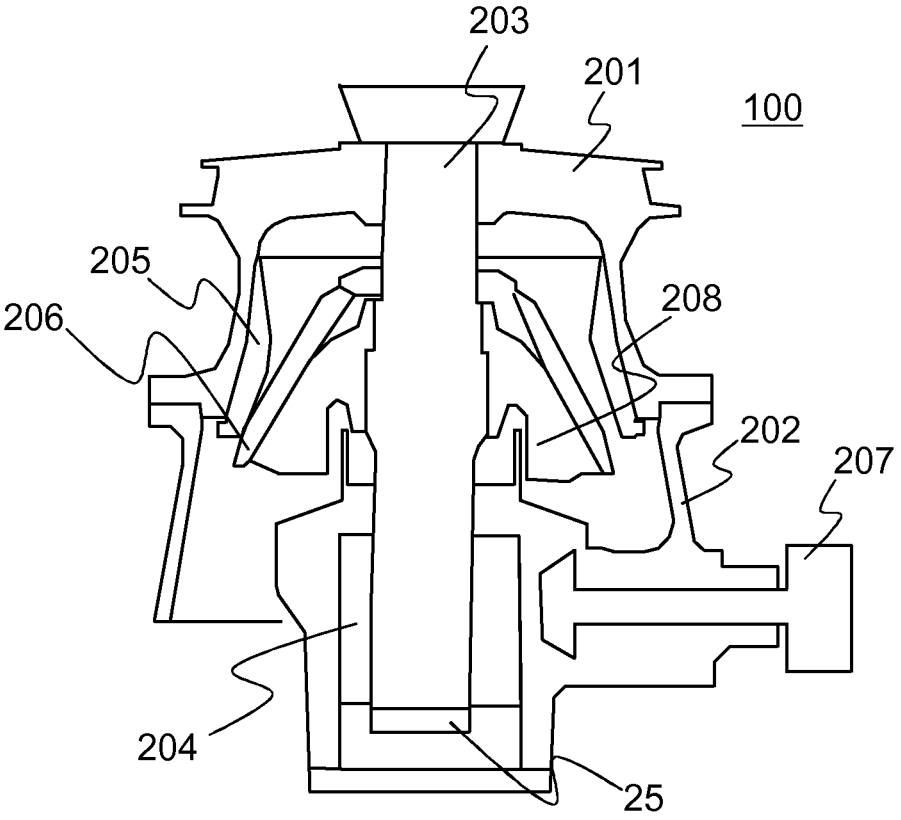
FIG. 5 shows a cone or gyratory crusher according to an example embodiment of the invention.

FIG. 5 shows a cone or gyratory crusher 100 according to an embodiment of the invention. The crusher comprises a frame, an upper frame 201 and a lower frame 202, a main shaft 203, a lubrication and adjusting piston 25, an eccentric assembly 204, an outer crushing part 205, an inner crushing part 206, a transmission 207 and a crusher head 208.

The transmission is arranged to rotate the eccentric assembly around the main shaft producing gyratory movement between the inner and the outer crushing parts.

The skilled person appreciates that the mineral material processing plant 400 can, in a further example embodiment, be a stationary mineral material processing plant comprising crushing, screening and conveying units. In a further example embodiment, the mobile processing plant may, instead of tracks depicted in FIG. 4, comprise wheels, legs, skids or other suitable support means.

Without in any way limiting the scope of protection, interpretation or possible applications of the invention, a technical advantage of different embodiments of the invention may be considered to be reduced risk of overheating of the thrust bearing. Further, a technical advantage of different embodiments of the invention may be considered to be lessened wear of the thrust bearing. Still further, a technical advantage of different embodiments of the invention may be considered to be increased lifetime of the crusher. Still further, a technical advantage of different embodiments of the invention may be considered to be increased safety.

The foregoing description provides non-limiting examples of some embodiments of the invention. It is clear to a person skilled in the art that the invention is not restricted to details presented, but that the invention can be implemented in other equivalent means. Some of the features of the above-disclosed embodiments may be used to advantage without the use of other features.

As such, the foregoing description shall be considered as merely illustrative of the principles of the invention, and not in limitation thereof. Hence, the scope of the invention is only restricted by the appended patent claims.

The invention claimed is:

1. A lubrication system for a gyratory crusher, comprising:

a thrust bearing;

a lubrication and adjusting piston arranged to be movable in a cylinder, the piston including an upper portion having a first outer diameter and a lower portion having a second outer diameter portion that forms a shoulder therebetween, wherein the first diameter is larger than the second diameter; wherein the piston comprises an internal first space configured to receive fluid and to continuously conduct the fluid to the thrust bearing; wherein the cylinder, an outer surface of the lower portion and the shoulder of the piston define therebetween a second space configured to receive and hold fluid; and that the system is configured to conduct fluid from the second space to the first space in response to downward movement of the piston.

2. The lubrication system of claim 1, further comprising a first channel connecting the first space with an outside of the piston.

3. A lubrication system for a gyratory crusher, comprising:

a thrust bearing;

a lubrication and adjusting piston arranged to be movable in a cylinder, wherein the piston includes a first space configured to receive fluid and to continuously conduct the fluid to the thrust bearing, wherein the cylinder and the piston define therebetween a second space configured to receive and hold fluid;

a first channel connecting the first space with an outside of the piston;

a second channel formed between the side surface of the piston and the cylinder; and connecting the first space with the second space, wherein the system is configured to in response to detecting a downward movement of the piston to conduct fluid from the second space to the first space.

4. The lubrication system of claim 3, further comprising a third channel connecting the second channel to a supply of fluid.

5. The lubrication system of claim 4, further comprising a fourth channel connecting the second space to the first space.

6. The lubrication system of claim 5, further comprising a third space above the thrust bearing inside the cylinder configured to receive fluid from the thrust bearing.

7. The lubrication system of claim 6, further comprising a fifth channel connecting the third space to the supply of fluid.

8. The lubrication system of claim 1, wherein the system is configured to in response to the pressure rising in the second space to conduct fluid from the second space to the first space via a first channel and a second channel and/or via a fourth channel.

9. The lubrication system of claim 1, further comprising further fluid transfer means for additionally supplying fluid to the first space in response to detecting the downward movement of the piston.

10. The lubrication system of claim 9, wherein the further fluid transfer means comprise a pump.

11. A lubrication method for a gyratory crusher, comprising:

supplying fluid to an internal first space inside a piston configured to receive fluid, the piston including an upper portion having a first outer diameter and a lower portion having a second outer diameter that forms a shoulder therebetween, wherein the first diameter is larger than the second diameter;

continuously conducting the fluid from the internal first space to a thrust bearing; and in response to detecting a downward movement of the piston through a rise in pressure in a second space formed between an outer surface of the lower portion and a cylinder wall, conducting fluid from the second space to the first space.

12. The method of claim 11, wherein the fluid is supplied to the first space via a first channel, a second channel and a third channel connected to a supply of fluid.

13. The method of claim 11, wherein the fluid is supplied to the second space via a second channel.

14. The method of claim 11, wherein the fluid is supplied from the thrust bearing to a third space above the thrust bearing inside the cylinder.

15. The method of claim 14, wherein the fluid is supplied from third space to the supply of fluid via a fifth channel.

16. The method of claim 11, wherein the fluid is supplied in response to the pressure rising in the second space to the first space via a first channel and a second channel and/or via a fourth channel.

17. The method of claim 11, wherein the fluid is supplied to the first space in response to detecting the downward movement of the piston additionally using further fluid transfer means.

18. The method of claim 17, wherein the further fluid transfer means comprise a pump.

19. A gyratory crusher comprising the lubrication system of claim 1.

20. A mineral material processing plant comprising a crusher according to claim 19.

21. A mineral material processing plant according to claim 20, wherein the mineral material processing plant comprises a mobile plant.

* * * * *